United States Patent [19]

Yukimi

[11] Patent Number: 4,995,561

[45] Date of Patent: Feb. 26, 1991

[54] GROUND SAND MAKER

[75] Inventor: Oogawara Yukimi, Tottori, Japan

[73] Assignee: Nakaya Jitsugyo Co., Ltd., Tottori, Japan

[21] Appl. No.: 419,205

[22] Filed: Oct. 10, 1989

[30] Foreign Application Priority Data

Feb. 23, 1989 [JP] Japan ..... 1-44336

[51] Int. Cl.[5] ..... B02C 17/02

[52] U.S. Cl. ..... 241/62; 241/79.3; 241/178; 241/183; 241/DIG. 10

[58] Field of Search ..... 241/DIG. 10, DIG. 30, 241/182, 183, 79.3, 171, 38, 62, 178; 164/5, 4, 2, 404

[56] References Cited

U.S. PATENT DOCUMENTS

| | | | |
|---|---|---|---|
| 788,675 | 5/1905 | Rissmuller | 241/79.3 X |
| 1,095,071 | 4/1914 | Beer | 241/183 X |
| 2,242,109 | 5/1941 | Camphuis | 241/183 X |
| 2,268,661 | 1/1942 | Kennedy | 241/183 |
| 2,819,130 | 1/1958 | Kaminsky | 241/178 X |
| 3,998,262 | 12/1976 | Didion | 164/404 X |
| 4,013,233 | 3/1977 | Nylund | 241/79.3 X |
| 4,154,290 | 5/1979 | Weststrate et al. | 164/404 |
| 4,687,146 | 8/1987 | Sundman | 241/79.3 |
| 4,848,681 | 7/1989 | Eriksson et al. | 241/183 |

FOREIGN PATENT DOCUMENTS

| | | | |
|---|---|---|---|
| 302551 | 2/1989 | European Pat. Off. | 241/79.3 |
| 1036610 | 8/1958 | Fed. Rep. of Germany | 241/183 |
| 1252016 | 8/1986 | U.S.S.R. | 164/412 |

*Primary Examiner*—Mark Rosenbaum
*Attorney, Agent, or Firm*—Kanesaka & Takeuchi

[57] ABSTRACT

A ground sand maker which includes a grinding drum (2); a mass of working pebbles (25) placed within the grinding drum; a driving device (7) for rotating the grinding drum; an inlet port (17) provided on a first end (2b) of the grinding drum for supplying rock fragments (28) and water (26) into the grinding drum; and an outlet sieve (20) provided on a circumferential surface (2a) of the grinding drum adjacent a second end (2c) opposite to the first end for discharging ground sand and water.

4 Claims, 7 Drawing Sheets

GROUND SAND MAKER

BACKGROUND OF THE INVENTION

The present invention relates generally to machines for making an aggregate for concrete and, more particularly, to a machine for making ground sand for concrete.

Rod mills for making crushed sand for concrete are well known. A rod mill includes a cylindrical crushing drum and a plurality of iron rods provided within the cylindrical drum. Rock fragments and water are supplied to the rotating crushing drum in which the iron rods exert impacts on the rock fragments to provide crushed sand.

In the above rod mill, the iron rods are lifted along the inside wall of the rotating drum and fall to crush the rock fragments. The hardness of the iron rods is much higher than that of the rock fragments so that the impacts upon the rock fragments are very high. The iron rods, however, do not sufficiently grind them to provide high quality sand.

Among river sand, mountain or pig sand, sea sand and land sand, the river sand is the hardest and has the most spherical shape and is the highest in quality as an aggregate. An experiment has shown that the particle shape percentage (unit volume mass divided by specific gravity in absolute dry condition) of a river sand sample prepared by washing with water according to Japan Industrial Standards (JIS) A 5004 is 57–59 percent while the particle shape percentage of the crushed sand obtained from the above rod mill is about 53 percent.

It is desirable that the particle size distribution curve falls between a pair of broken lines A and B in FIG. 13 (standard particle size range of a fine aggregate for concrete according to the Japanese Society of Civil Engineers). A test has shown that the particle size distribution curve of the crushed sands made by the rod mill does not always fall within the range.

In other words, the crushed sand made by the rod mill has flat and sharp particles with rough surfaces. Some of the particles even have a crack. These properties have adverse effects on the concrete characteristics such as workability and fluidity.

Hence, this inventor has proposed a machine for making ground sand for concrete in Japanese Patent Application No. 63-254539. This machine includes a cylindrical drum and a plurality of pebbles placed within the drum. Rock fragments (sand) and water are supplied to the rotating grinding drum through an inlet port on one end of the drum and ground sand is discharged through an outlet port on the other end of the drum. In this machine the rock fragments are ground by the pebbles and water with friction in a way similar to a river so that impurities are removed from the rock fragments, and sand having spherical particles with smooth surfaces without a crack are obtained in a short period of time.

The above machine, however, has the following disadvantages.

Rock fragments and water are supplied through the inlet port on one end of the drum and the ground sand and water is discharged through the outlet port on the opposite end. This outlet port is placed somewhere around the axis of the drum so that there is a very small centrifugal force acting on the ground sand in the vicinity of the outlet port, let alone a force acting along the axis. As a result, the fluidity of the ground sand near the outlet port is so low that the ground sand is not efficiently discharged through the outlet port.

In addition, water is supplied through the inlet port on only one end so that the water fails to sufficiently separate the ground sand from the working pebbles, impairing discharge of the ground sand.

Moreover, the inside surfaces of the end walls are so smooth that the rock fragments and working pebbles are slipping on the surface, failing to make any contribution to the grinding action within the drum.

SUMMARY OF THE INVENTION

Accordingly, it is an object of the invention to provide a ground sand maker with high efficiency in discharge of the ground sand from the drum.

It is another object of the invention to provide a ground sand maker with good separation of the ground sand from the working pebbles by making use of water.

It is still another object of the invention to provide a ground sand maker with high grinding efficiency.

According to one aspect of the invention there is provided a ground sand maker which includes a grinding drum; a mass of working pebbles placed within the grinding drum; a driving device for rotating the grinding drum; an inlet port provided on a first end of the grinding drum for supplying rock fragments and water into the grinding drum; and an outlet sieve provided on a circumferential surface of the grinding drum adjacent a second end opposite to the first end for discharging ground sand and water.

According to another aspect of the invention there is provided a ground sand maker which includes an inlet port provided on one end of the grinding drum, an opening provided on the other end, and a device provided in the opening for supplying water to the grinding drum.

According to still another aspect of the invention there is provided on the inside of at least one of the ends of the drum for stirring and pushing the working pebbles, rock fragments, and water toward the center of the drum.

Rock fragments and water are supplied through the inlet port to the grinding drum in which working pebbles have been placed. The working pebbles, rock fragments, and water are stirred by rotating the drum, and the ground sand and water are discharged from the drum through the outlet port which is provided on the circumferential surface of the drum so that the ground sand and water are discharged smoothly and quickly by a large centrifugal force. The sieve member put on the outlet port permits the ground sand of only the desired particle sizes to be discharged.

The water poured into the grinding drum through the device provided near the outlet port in addition to the inlet port promotes separation of the ground sand from the working pebbles.

The device provided on the inside of at least one of the ends of the drum stirs and pushes the working pebbles and rock fragments towards the center of the drum thereby increasing the grinding action.

Other objects, features, and advantages of the invention will be apparent from the following description when taken in conjunction with the accompanying drawings.

DESCRIPTION OF THE PREFERRED EMBODIMENT

Figure 1:
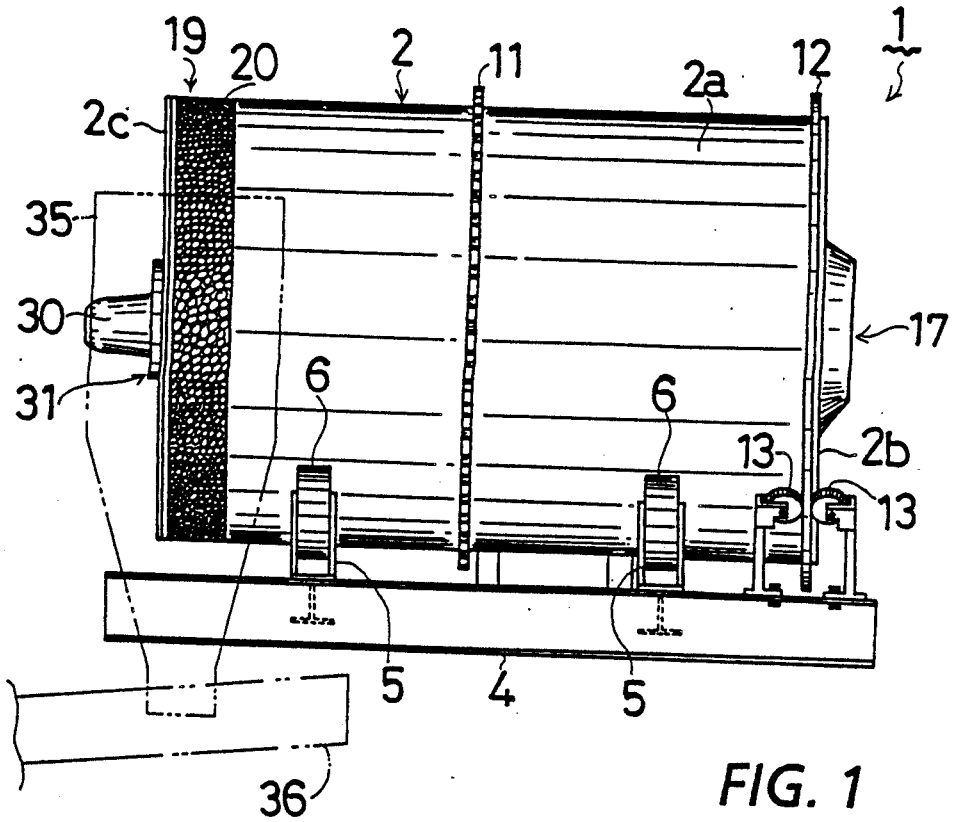
FIG. 1 is an elevational left side view of a ground sand maker according to an embodiment of the invention.
Figure 2:
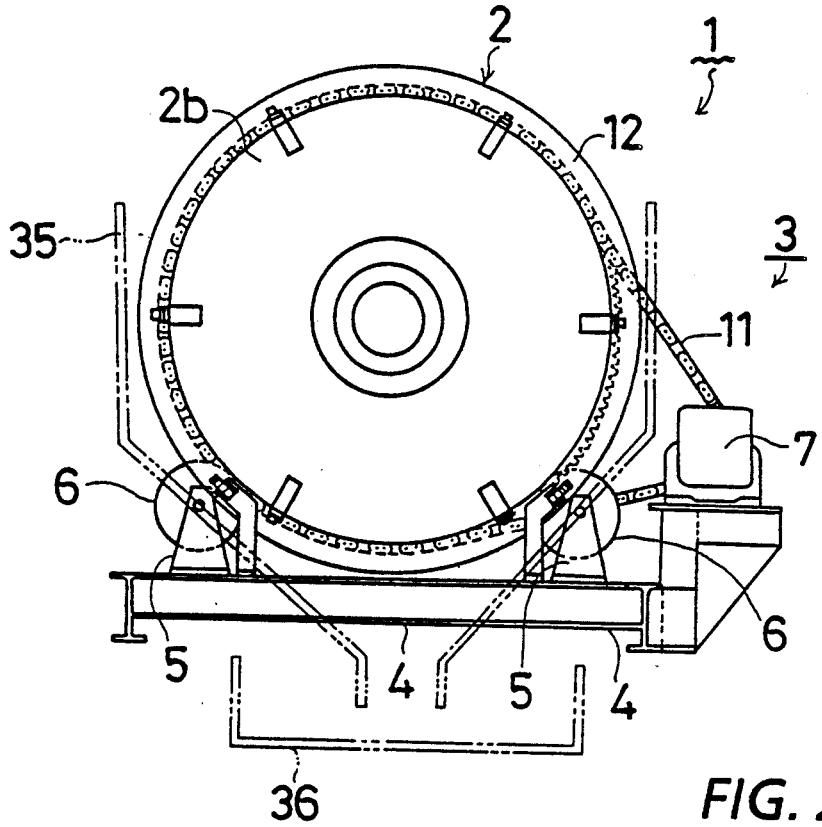
FIG. 2 is a front view of the ground sand maker.
Figure 3:
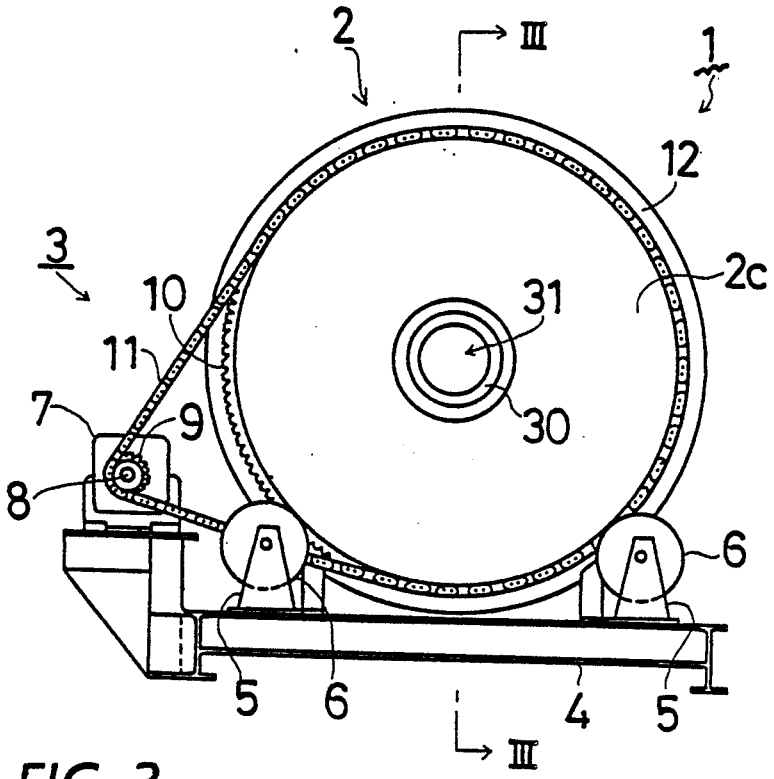
FIG. 3 is a rear view of the ground sand maker.
Figure 4:
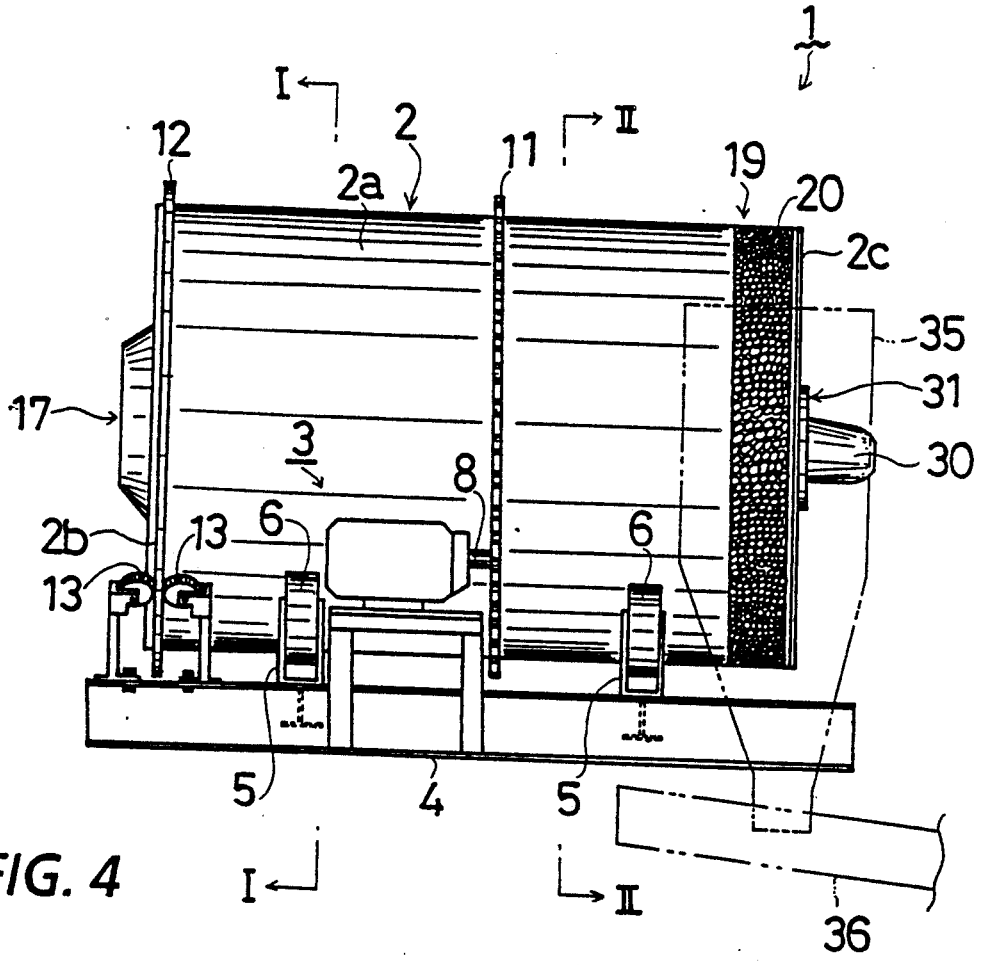
FIG. 4 is an elevational right side view of the ground sand maker.
Figure 5:
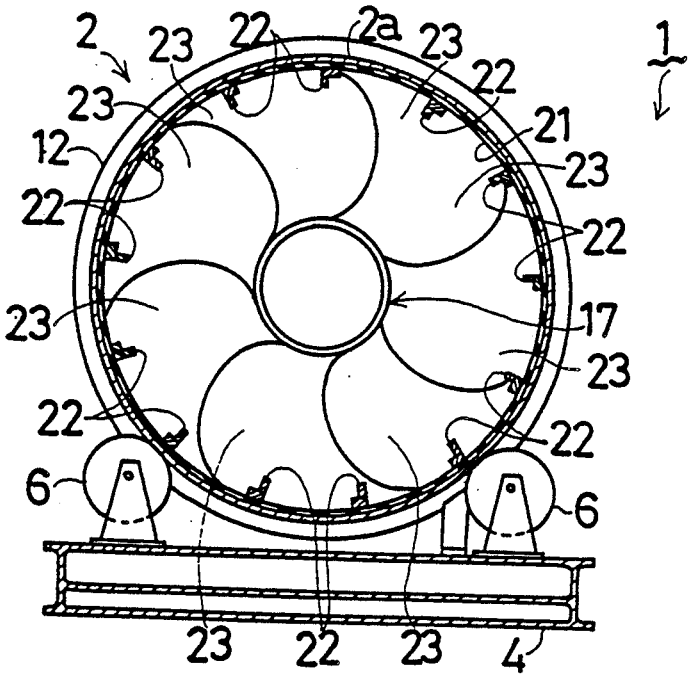
FIG. 5 is a cross section taken along the line I—I of FIG. 4.
Figure 6:
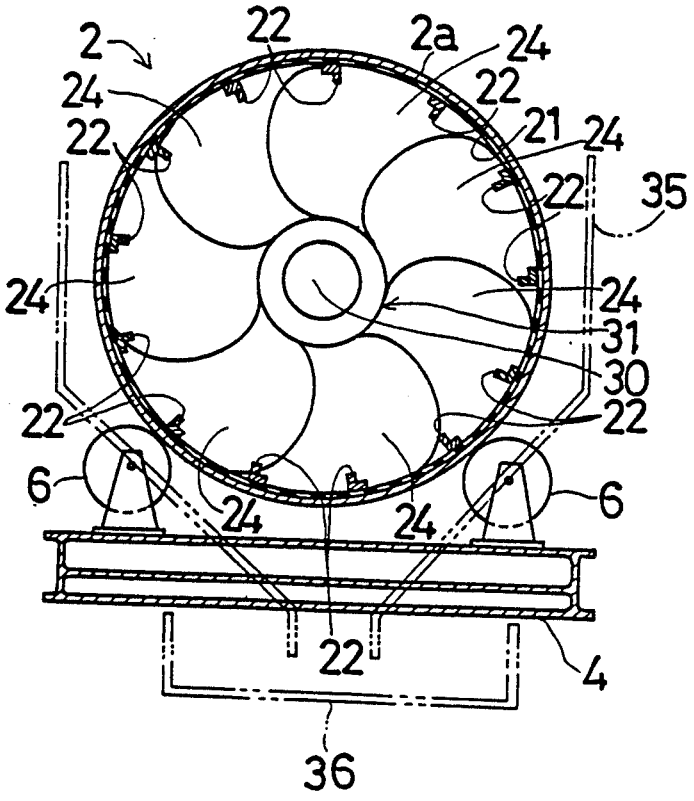
FIG. 6 is a cross section taken along the line II—II of FIG. 4.
Figure 7:
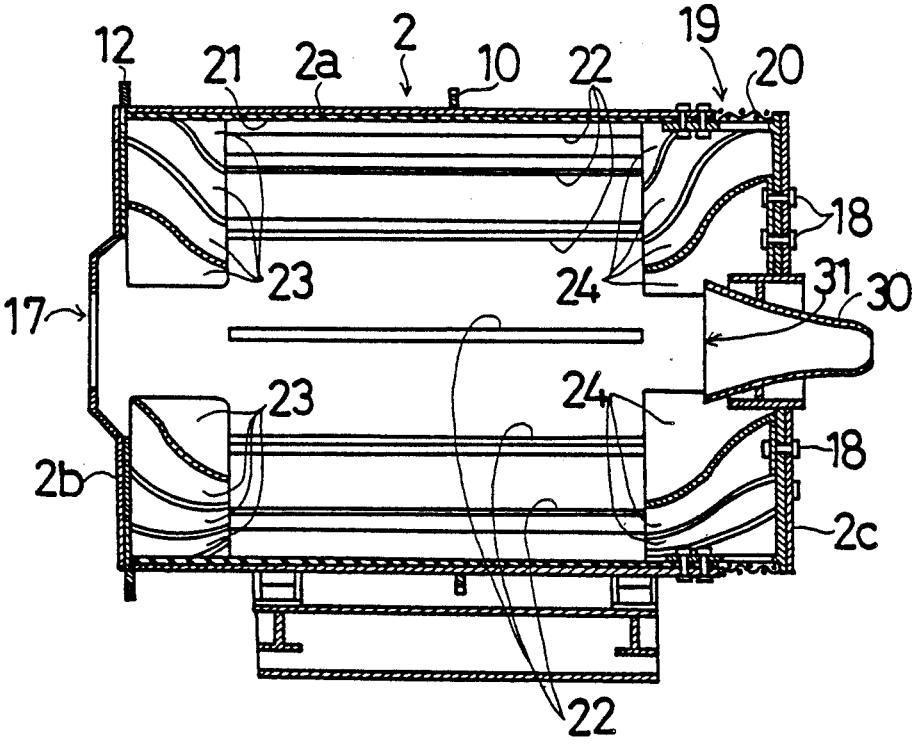
FIG. 7 is a longitudinal section taken along the line III—III of FIG. 3.
Figure 8:
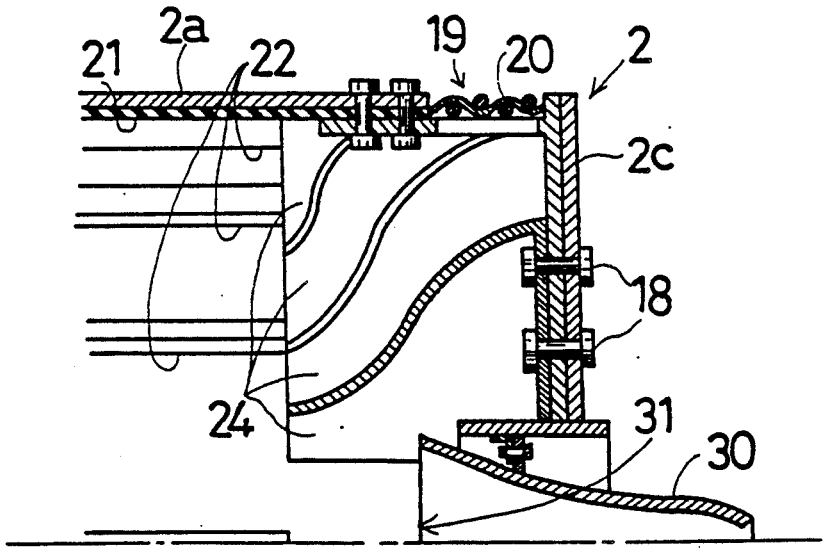
FIG. 8 is an enlarged view of the discharge portion of the ground sand maker.

In FIGS. 1–4, a ground sand maker 1 includes a cylindrical grinding drum 2 and a driving device 3 for rotating the drum 2. The driving device 3 includes a base 4, four rollers 6 mounted on the base 4 with a bracket 5, a motor 7 mounted on one side of the base 4, a sprocket 9 secured to the motor shaft 8, a follower sprocket 10 provided on the middle of a circumferential wall 2*a* of the drum 2, and a chain 11 put on the sprockets 9 and 10. The rotary power of the motor 7 is transmitted to the drum 2 via the chain 11 so that the drum 2 rotates on the rollers 6.

Alternatively, the sprockets 9 and 10 may be toothed pulleys or V-shaped pulleys, and the chain 11 may be a timing belt or V-belt.

Figure 12:
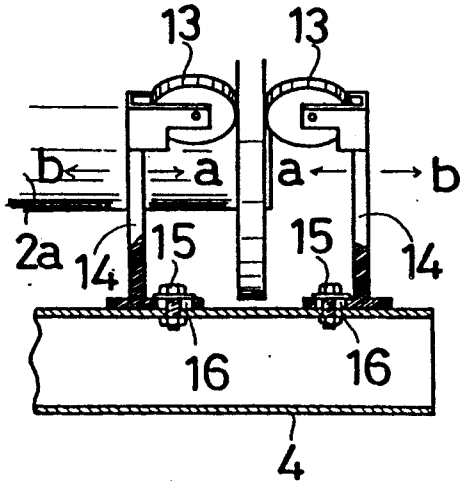
FIG. 12 is an enlarged view of part of the ground sand maker.

As best shown in FIG. 12, two pairs of rollers 13, each holding an edge 12 of an end wall 2*b* of the drum 2, are mounted on opposite sides of the base 4 via brackets 14 with bolts 15 which are inserted in slots 16 so that it is possible to adjust the brackets 14 in an a-b direction as rollers are wearing out.

An inlet port 17 is provided at the center of the end wall 2*b* for supplying rock fragments and water. A outlet port 19 is provided along the circumferential surface 2*a* adjacent the other end wall 2*c*. A sieve member 20 is put on the outlet port 19 through which the ground sand and water are discharged. The mesh of the sieve member 20 is made about 10 mm.

As best shown in FIGS. 5–8, a buffer sheet 21 is bonded onto the inside of the circumferential wall 2*a* for lessening impacts. The buffer sheet 21 is made from natural rubber and has high friction resistance and also serves as a cushion. A plurality of parallel elongated projections 22 are provided at regular intervals on the inside of the circumferential wall 2*a*. A plurality of stirring blades 23 and 24 are secured to the end walls 2*b* and 2*c* with fasteners 18 for stirring the rock fragments and moving the ground sand toward the outlet port.

Figure 9:
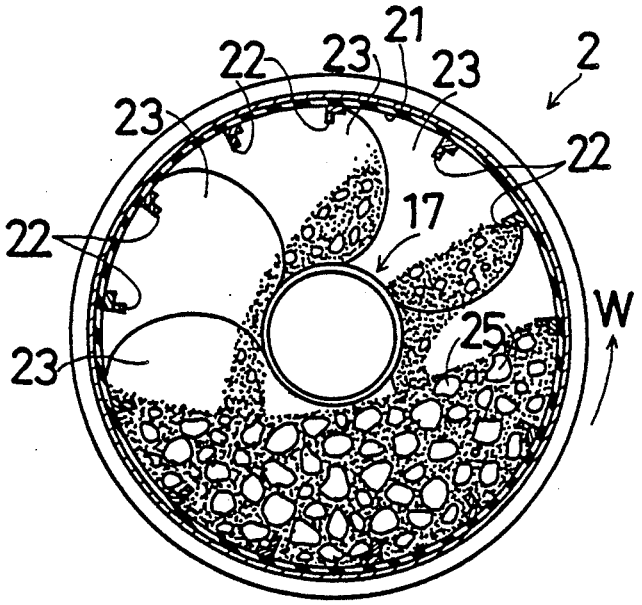
FIG. 9 is a cross section of a front portion of the ground sand maker in operation.
Figure 10:
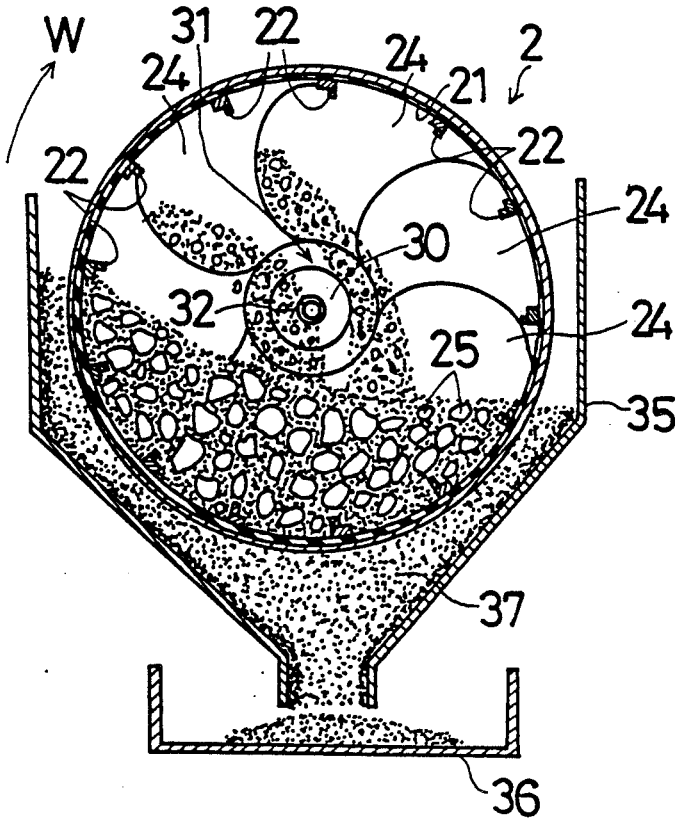
FIG. 10 is a cross section of a rear portion of the ground sand maker in operation.
Figure 11:
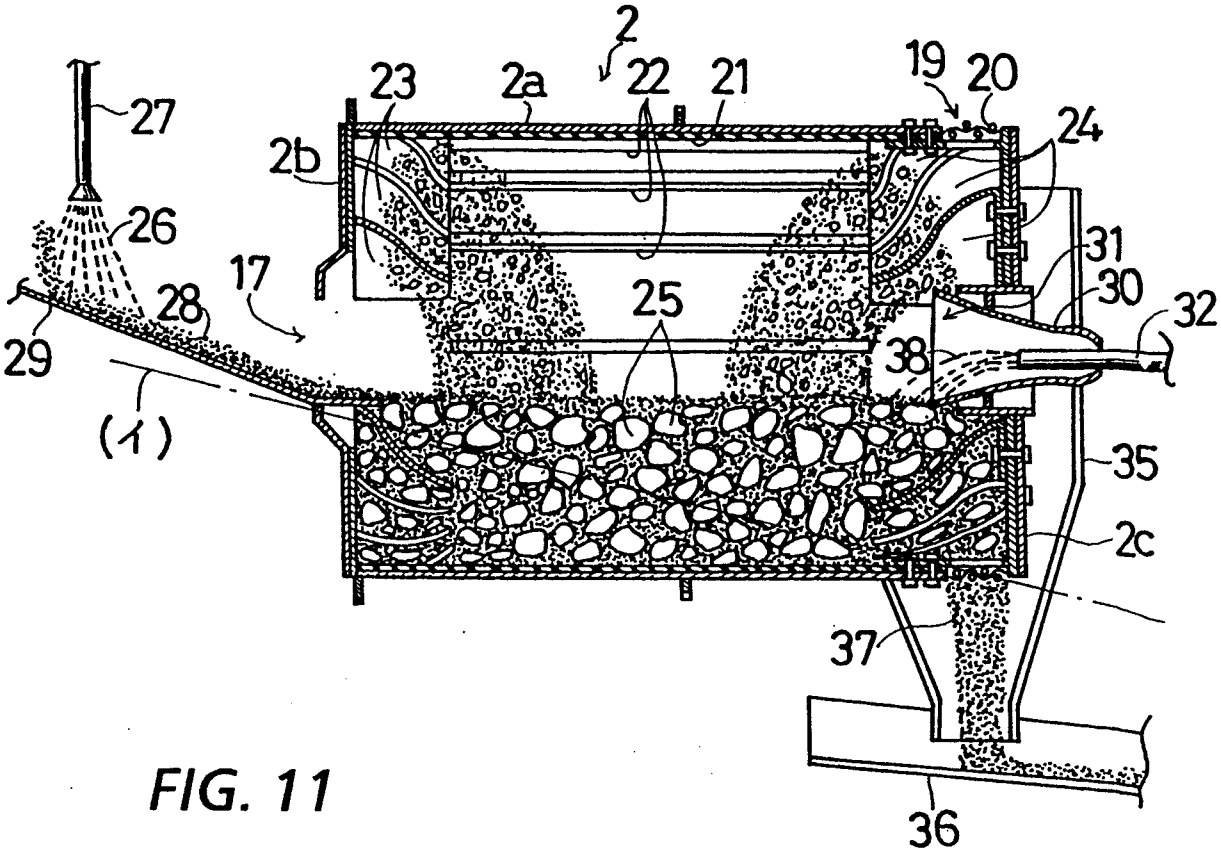
FIG. 11 is a longitudinal section of the ground sand maker in operation.

As best shown in FIGS. 9–11, a plurality of working pebbles 25 having particle sizes greater than 10 mm or the mesh of the sieve member 20 are placed in the grinding drum 2. The working pebbles are replenished in a unit of 1.0–1.5 kg.

A spray gun 27 is provided adjacent the end wall 2*b* for supplying water. A chute 29 is provided for guiding the water 26 and rock fragments (sand) 28 into the inlet port 17. Examples of the rock fragments (sand) 28 are sea sand, pit sand, and ground stone. A duct 30 with an opening 31 is provided at the center of the opposite end wall 2*c*. A pipe 32 is inserted into the opening 31 for supplying water. A receiver 35 is provided to cover the lower portion of the outlet port 19, and a discharge chute 36 is provided beneath the receiver 35.

In operation, a plurality of working pebbles 25 are placed in the grinding drum 2, and water 26 and rock fragments 28 are continuously supplied to the grinding drum 2 through the inlet port 17 via the chute 29 while the motor 7 is rotated to turn the grinding drum 2 in the direction W in FIG. 9 for crushing and grinding the rock fragments 28 with the working pebbles 25 and the water 26. The resulting ground sand 37 and water are discharged through the sieve member 20 at the outlet port 19 into the receiver 35 and then the discharging chute 36.

As best shown in FIGS. 9 and 11, the stirring blades 23 lift the working pebbles 25, the rock fragments 28 and the water in the vicinity of the inlet port 17 and push them toward the center of the grinding drum thus increasing the grinding efficiency. In addition, the efficiency of transport of the rock fragments 28 toward the outlet port 19 is higher than the efficiency of transport made by only the water 26 from the spray gun 27.

As best shown in FIGS. 10 and 11, the stirring blades 24 lift the working pebbles 25, the rock fragments 28, and the water in the vicinity of the outlet port 19 and pushed them toward the center, thereby increasing the grinding efficiency. The water 38 poured through the pipe 32 helps separation of the ground sand from the working pebbles 25, thereby promoting discharge of the ground sand through the outlet port 19.

The grinding action is carried out along the inclined line (L) passing through the inlet port 17 and the outlet port 19. This resembles a natural river in which ground sand is produced. In other words, spherical particles of the rock fragments 28 are gradually pulverized with friction while flat rock fragments are crushed, and salt, clay, and shell fragments are removed therefrom.

The rubber sheet 21 on the inside of the grinding drum 2 lessens the impact produced between the rock fragments 28 and the working pebbles 25 and the circumferential wall 2*a*, thereby preventing any high impact with which all of the rock fragments are crushed such as in the conventional rod mill.

The high friction resistance of the rubber sheet 21 increases the pulling up action by the inside of the circumferential wall 2*a*, thus increasing the grinding efficiency. Simultaneously, the elongated projections 22 constantly change the positions of the working pebbles 25, thereby providing even grinding action on the rock fragments 28.

The ground sand 37 thus made is discharged through the outlet port 19 by the centrifugal force into the receiver 35 and then the discharge chute 36. The ground sand 37 and water is supplied to a grade separator (not shown) to separate the ground sand from the water. A test showed that the particle shape percentage of the ground sand 37 was 58–59 percent, indicating that the ground sand is very close in characteristics to the river sand.

Figure 13:
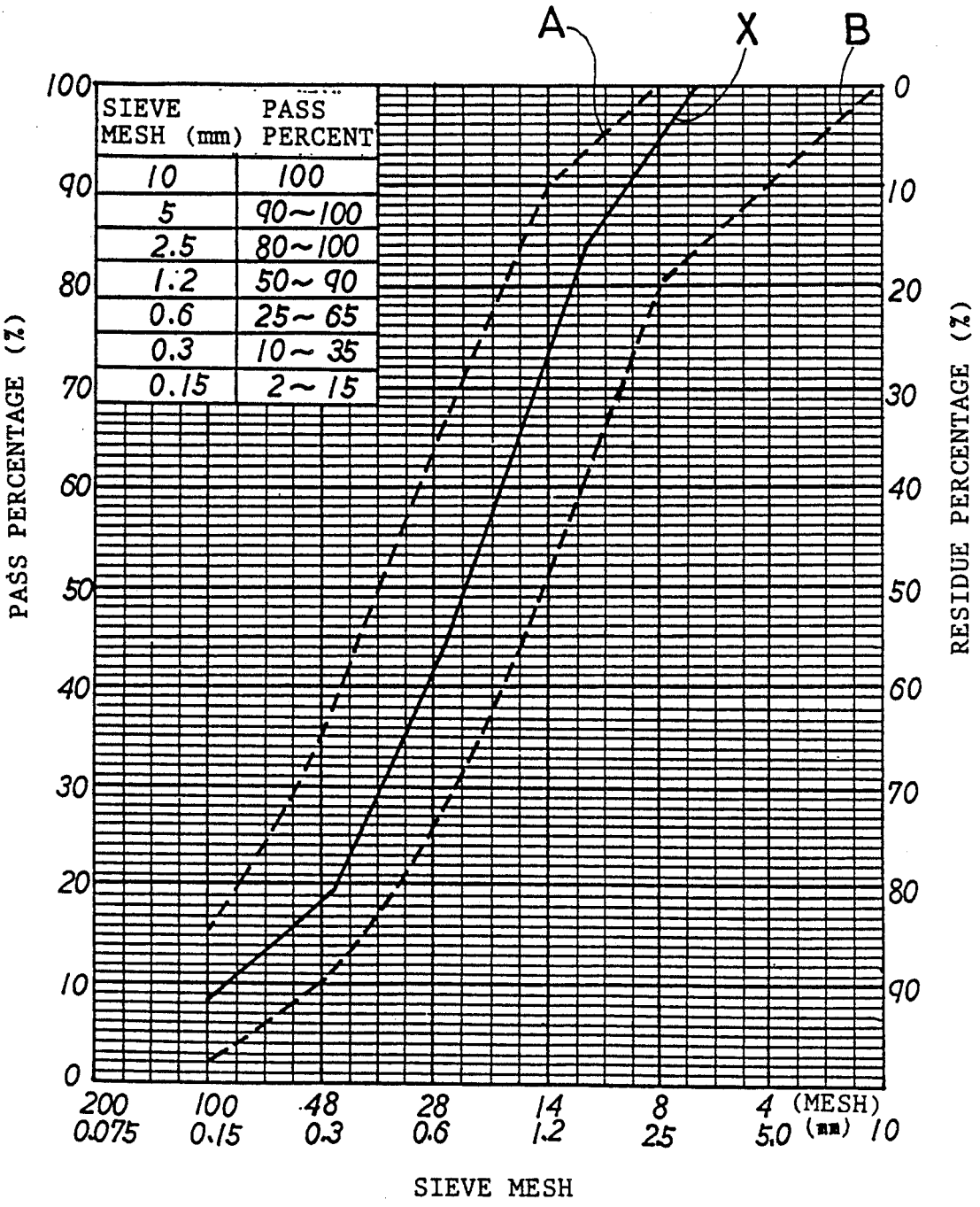
FIG. 13 is a graph showing the particle size distribution of the ground sand.

As shown in FIG. 13, the test showed that the particle size distribution curve X of the ground sand 37 not only fell within the range between the broken lines A and B but also ran along the center, indicating that the ground sand 37 is even in quality.

A plurality of the ground sand makers 1 may be connected in series such that the ground sand from the discharge chute 36 of a ground sand maker is supplied to the inlet port 17 of a subsequent ground sand maker. In this arrangement, high quality ground sand may be obtained from even a mixture of different rock fragments.

Alternatively, only one set of the grinding blades 23 or 24 may be provided for simpler structure which yet has the increased grinding efficiency.

As has been described above, the outlet port is provided on the circumferential surface of the drum so that a large centrifugal force forcefully discharges the ground sand through the outlet port, thereby increasing the productivity.

In addition to the water supplied through one end of the drum, water is supplied through the other end to promote separation of the ground sand from the working pebbles.

With the stirring device mounted on the inside of at least one of the ends of the drum, it is possible to provide a grinding action on the opposite ends as well as the circumferential surface, thus increasing the grinding efficiency.

I claim:

1. A ground sand maker comprising:

a grinding drum having a circumferential surface, a first end wall with an end edge, and a second end wall opposed to said first end wall;

a mass of working pebbles placed within said grinding drum;

driving means for rotating said grinding drum, said driving means includiing a plurality of rollers on which said grinding drum is placed for rotation and at least one pair of rollers for holding said end edge between them;

an inlet port provided on said first end wall for supplying rock fragments and water into said grinding drum; and an outlet sieve provided on said circumferential surface adjacent said second end wall for discharging sand and water.

2. The ground sand maker of claim 1, wherein said grinding drum comprises:

a buffer sheet secured to the inside of said circumferential surface to lessen an impact on said rock fragments; and a plurality of detachable parallel elongated projections attached to said buffer sheet for changing positons of said working pebbles as said grinding drum rotates.

3. The ground sand maker of claim 2, wherein said grinding drum has a plurality of stirring blades on an inside of at least one of said end walls for stirring and pushing said working pebbles, rock fragments, and water toward a center of said grinding drum in an axial direction of said drum, thereby promoting grinding action within said grinding drum.

4. A ground sand maker comprising:

a grinding drum having a circumferential surface, a first end wall with an end edge, and a second end wall opposed to said first end wall;

a mass of working pebbles placed within said grinding drum;

driving means for rotating said grinding drum, said driving means including a plurality of rollers on which said grinding drum is placed for rotation and at least one pair of rollers for holding said end edge between them;

an inlet port provided on said first end wall for supplying rock fragments and water into said grinding drum;

an outlet sieve provided on said circumferential surface adjacent said second end wall for discharging ground sand and water;

a buffer sheet secured to an inside of said circumferential surface to lessen an impact on said rock fragments;

a plurality of detachable parallel elongated projections attached to said buffer sheet for changing positions of said working pebbles as said grinding drum rotates;

said grinding drum has a plurality of stirring blades on an inside of at least one of said end walls for stirring and pushing said working pebbles, rock fragments, and water toward a center of said grinding drum in an axial direction of said drum, thereby promoting grinding action within said grinding drum.

* * * * *